United States Patent [19]

Niles

[11] 4,175,685

[45] Nov. 27, 1979

[54] TAPE DISPENSER WITH BLADE GUARD

[75] Inventor: Gerald J. Niles, St. Paul, Minn.

[73] Assignee: Minnesota Mining and Manufacturing Company, St. Paul, Minn.

[21] Appl. No.: 918,349

[22] Filed: Jun. 23, 1978

[51] Int. Cl.[2] ..... B26F 3/02; B26D 7/22

[52] U.S. Cl. ..... 225/19; 83/545

[58] Field of Search ..... 225/19, 20; 83/545, 83/544; 30/346.58, 78

[56] References Cited

U.S. PATENT DOCUMENTS

| | | | |
|---|---|---|---|
| 72,186 | 12/1867 | Garrick | 225/19 |
| 1,837,180 | 12/1931 | Bennett, Jr. et al. | 225/19 X |
| 2,798,551 | 7/1957 | Polster | 225/19 |
| 3,505,734 | 4/1970 | Iten | 30/346.58 |
| 4,059,210 | 11/1977 | Deering, Jr. | 225/47 |
| 4,094,066 | 6/1978 | Daniel, Jr. | 30/346.58 |

*Primary Examiner*—Frank T. Yost

*Attorney, Agent, or Firm*—Cruzan Alexander; Donald M. Sell; John C. Barnes

[57] ABSTRACT

A tape dispenser having a cutting blade comprising a razor blade with a self-contained guard in the form of a plurality of spiral windings of a flexible material with the windings spaced to permit the cutting of the edge of polyester and polypropylene-backed pressure-sensitive adhesive tapes.

2 Claims, 4 Drawing Figures

TAPE DISPENSER WITH BLADE GUARD

BACKGROUND OF THE INVENTION

1. Field of the Invention

This invention relates to an improvement in tape dispensers, especially tape dispensers for use with polyester and polypropylene-backed pressure-sensitive adhesive tapes to permit the same to be severed easily and to protect the operator of the dispensers.

2. Description of the Prior Art

Prior art dispensers have been known for years for use with a pressure-sensitive adhesive tape and the tape is readily dispensed by drawing a length of tape from a convolutely wound roll of tape and moving the same past a severing blade and then springing the blade into contact with the tape to sever the dispensed lengths thereof. This is done by manual dispensers wherein the tape is lifted from a smooth supporting surface on a standard spaced from the roll of tape and pulling by hand to draw the tape from the roll and then placing the tape down against the standard and into contact with the cutting member to transversely sever the dispensed lengths of tape from the remainder of the roll. In most tape dispensers the blade constitutes a sheet metal blade having a severing edge which is conveniently serrated or formed with a plurality of sharp points or teeth to cut the tape backing. These serrated edges or tooth edges are not sufficient however to cut polyester or polypropylene-backed tapes which require that the edges be severed by a sharper instrument. The use of razor blades in a tape dispenser is known except the use of raxor blades necessitates a guard of some sort to prevent one from accidently nicking a finger each time the tape is severed over the blade.

With the increased use of plastic tapes having backing of the strength of polyester and polypropylene it has become a problem to find a blade which may be readily exposed in the cutting position but yet one which will protect the operator and make the dispenser safe to market. Attempts to provide such a dispenser have included the use of a coarse grit sandpaper or similar material at the cutting edge to fracture the edges of the tape such that the same could be torn across the width of the tape. These blades with the coarse grit cause the severed tape to have a very jagged edge, resulting in a poor appearance for the severed length of tape.

SUMMARY OF THE PRESENT INVENTION

This invention relates to the combination of the frame of a tape dispenser, a support for tape on that frame and a second support including a receptacle for a cutting blade comprising a razor blade with a self-contained guard in the form of a plurality of spiral windings of a flexible material capable of being pressed against the razor blade edge by the tape without severing the flexible material.

The blade per se is known in the prior art and is described in U.S. Pat. No, 3,505,734, issued Apr. 13, 1970 to C. A. Iten.

DESCRIPTION OF THE DRAWING

The invention will be further understood with reference to the attached drawing wherein.

DETAILED DESCRIPTION OF THE INVENTION

Figure 1:
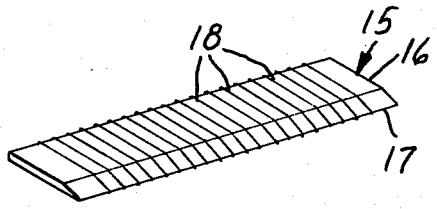
FIG. 1 is a view in perspective of a representative type of blade having a guard thereon.
Figure 2:
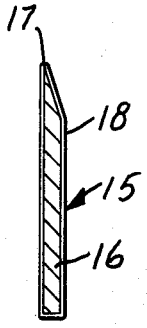
FIG. 2 is an enlarged cross-sectional view of the blade of FIG. 1, illustrating the flexible material wound about the blade and partially embedded in the extreme blade cutting edge.
Figure 3:
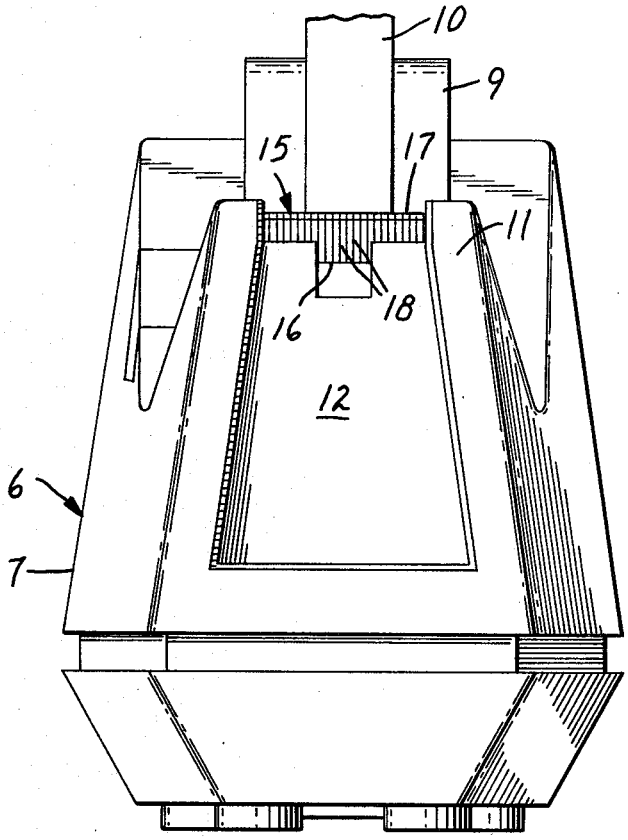
FIG. 3 discloses a front view of a pressure-sensitive adhesive tape dispenser incorporating a blade as shown in FIG. 1.

Referring now to the accompanying drawing wherein like reference numerals appear on like parts throughout, there is disclosed a pressure-sensitive adhesive tape dispenser 6 comprising a base 7, a first support 9 for rotatably supporting the core of a roll of convolutely wound pressure-sensitive adhesive tape 10. The dispenser 6 may be of a form described in U.S. Pat. No. 4,059,210, issued Nov. 22, 1977, to H. W. Deering, Jr. This dispenser is characterized by the fact that it includes a slidable support which includes a mandrel, such as that identified as the support 9, to permit the core of a roll of tape to be rotatably supported on the dispenser flame.

Spaced from the support 9 for the roll of tape is a second support or standard 11. The standard 11 is formed with a smooth support surface to which the tape will lightly and detachably adhere (not shown). The smooth support surface is disposed between the support 9 for the roll of tape 10 and a receptacle for the cutting blade. The standard has upstanding spaced ears to define guides and guards at the corners of a cutting blade 15. The receptacle for the cutting blade in the illustrated dispenser comprises a slot formed in the standard 11 of the dispenser 6 rearwardly of the front plate 12 and extending the width of the path over which the pressure-sensitive adhesive tape will be dispensed.

The cutting blade 15 is disposed in the slot for severing the tape. The cutting blade 15 is formed as described in U.S. Pat. No. 3,505,734, issued Apr. 14, 1972 to C. A. Iten.

The blade 15 comprises a razor blade 16 having a razor blade edge 17 and a self-contained guard in the form of a thin flexible material 18 wound spirally around the blade to conform with the contour of the blade surface.

The razor blade 16 may have the dimensions and proportions comparable to those of other commercially available razor blades but it comprises a guard which prevents the cutting of the skin when brought into contact with the blade. The blade was especially designed for use in shaving to protect the skin of the shaver, and while it reduced the drag on the skin it allowed the hairs to come into contact with the blade while preventing the very sharp razor egde from cutting the skin. The blade thus is not designed for use in cutting a web since it would normally maintain a web in a spaced condition separated from the cutting edge of the blade. However, as the tape is dispensed and pulled across the blade it is twisted slightly during the severing action to bring one edge of the tape into contact with the blade between the windings of flexible material 18, such that the edge of the tape is initially cut, permitting the remainder of the tape to be cut progressively along the blade edge.

The flexible material 18 may be of any type of material which is flexible and capable of conforming to the shape of the blade to which it is applied and capable of being pressed against the ultimate cutting edge of the blade without severing the material. The material is wound spirally under tension and as a consequence the respective passes over the thin delicate extreme cutting edge will be embedded to some extent, breaking down the edge and forming a notch therein. The material is preferably fine metal wire of steel but other materials may be employed such as glass fiber thread or some synthetic such as a tough grade of nylon. The flexible wire or thread-like material may have a diameter within the range of 0.0025 to 0.01 inch and the spacing between adjacent windings of the thread or wire-like material may be in the range of 0.010 to 0.05 inches. The windings are made in the range of about 10 to 60 windings per inch, determined of course, by the diameter of the material.

Figure 4:
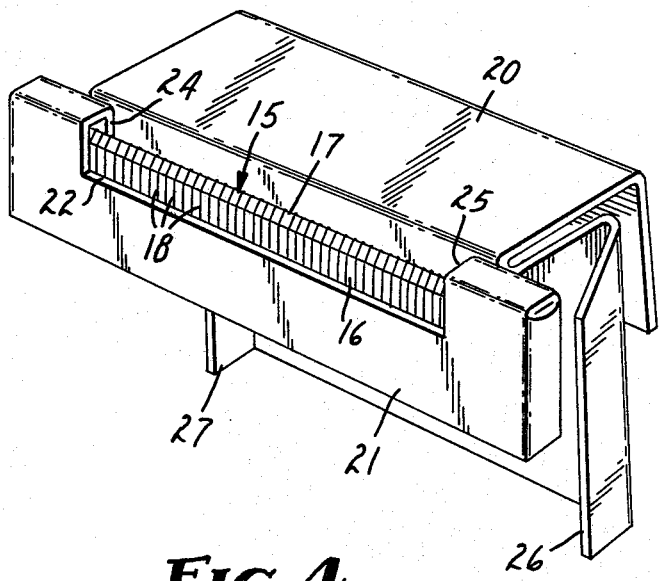
FIG. 4 is a view in perspective of an attachment for a standard of a tape dispenser permitting the cutting blade and tape supporting surface to be attached to a standard of a tape dispenser.

Referring now to FIG. 4 there is shown a bracket for attachment to the standard of a tape dispenser. This bracket comprises a folded sheet metal assembly having a right angle folded member defining a smooth hard surface 20 to which a pressure-sensitive adhesive tape may be lightly and detachably adhered after the tape is drawn down into engagement with the cutting edge 17 of the cutting blade 15 which is disposed in a holder 21 formed on the front of the bracket. The holder 21 is in the form of a sleeve to receive the blade from one end. The sleeve has an opening 22 along its length, exposing one portion of the blade including the ultimate cutting edge 17 guarded by the flexible material 18. The opening 22 also provides for two upstanding edges 24 and 25 which define the path for drawing the tape across the bracket and protects the corners of the blade edge 17. Downwardly extending wings 26 and 27 allow the brackets to be supported in a slot in a tape dispenser or to fit about the edge of an upstanding standard.

I claim:

1. A pressure-sensitive adhesive tape dispenser comprising a frame, a first support on said frame for supporting a roll of convolutely wound tape, a second support on said frame which is spaced from said first support and including a smooth surface to which said tape will lightly and detachably adhere by its pressure-sensitive coating and a receptacle for a cutting blade, said cutting blade comprising a razor blade with a self-contained guard in the form of a flexible material spirally wound to conform with the contour of the blade surface, and capable of being pressed against the razor blade edge by said tape without severance of the flexible material.

2. A tape dispenser as defined in claim 1 wherein said flexible material comprises a steel wire having a diameter within the range of 0.0025 to 0.01 inch, and the spacing between adjacent windings is in the range of 0.010 to 0.05 inch.

* * * * *